United States Patent [19]

Corey

[11] Patent Number: 4,984,617

[45] Date of Patent: Jan. 15, 1991

[54] ENVELOPED BLIND ASSEMBLY USING INDEPENDENTLY ACTUATED SLATS WITHIN A CELLULAR STRUCTURE

[75] Inventor: John A. Corey, Melrose, N.Y.

[73] Assignee: Comfortex Corporation, Cohoes, N.Y.

[21] Appl. No.: 431,297

[22] Filed: Nov. 2, 1989

[51] Int. Cl.[5] ..... A47H 5/00

[52] U.S. Cl. ..... 160/84.1; 160/89; 160/166.1

[58] Field of Search ..... 160/84.1, 130, 166.1, 160/113, 115, 127, 129, 168.1, 176.1, 89, 405

[56] References Cited

U.S. PATENT DOCUMENTS

| | | | |
|---|---|---|---|
| 2,201,356 | 5/1940 | Terrell | 160/84.1 |
| 2,914,122 | 11/1959 | Pinto | 160/89 |
| 2,994,370 | 8/1961 | Pinto | 160/89 |
| 3,946,789 | 3/1976 | Ronkholz-Toelle | 160/84.1 X |
| 4,019,554 | 4/1977 | Rasmussen | 160/84.1 |
| 4,307,768 | 12/1981 | Anderson | 160/84.1 |
| 4,347,887 | 9/1982 | Brown | 160/84.1 |
| 4,535,828 | 8/1985 | Brockhaus | 160/84.1 |
| 4,677,012 | 6/1987 | Anderson | 160/84.1 X |
| 4,708,188 | 11/1987 | Bytheway | 160/174 |
| 4,723,586 | 2/1988 | Spangenberg | 160/107 |

*Primary Examiner*—David M. Purol

*Attorney, Agent, or Firm*—Schmeiser, Morelle & Watts

[57] ABSTRACT

A window covering (10) having the appearance of a pleated curtain of the expansible-collapsible type and containing therein, and discretely postured within at least one plane of cells, an array of slats (30) capable of arcuate movement by a cord ladder (18, 19, 22) apparatus. The preferred embodiment of the invention (10) uses a multicellular curtain of the pleated type (14), and especially one having a continuous web-like ligature connecting the internal acute vertices of the cells. A Venetian blind apparatus is interposed between the outside pleated faces of the cell network so that a blind slat (30) may be rotated from a rest position on one cell ligament (28) and into contact with an adjoining cell ligament (31). Through an array of reflectively coated or opacified slats (26) or ligaments (28), in combination with the rotatable Venetian blind slats (30), light diffusing through the curtain (14) is readily controlled.

12 Claims, 4 Drawing Sheets

FIG. 1
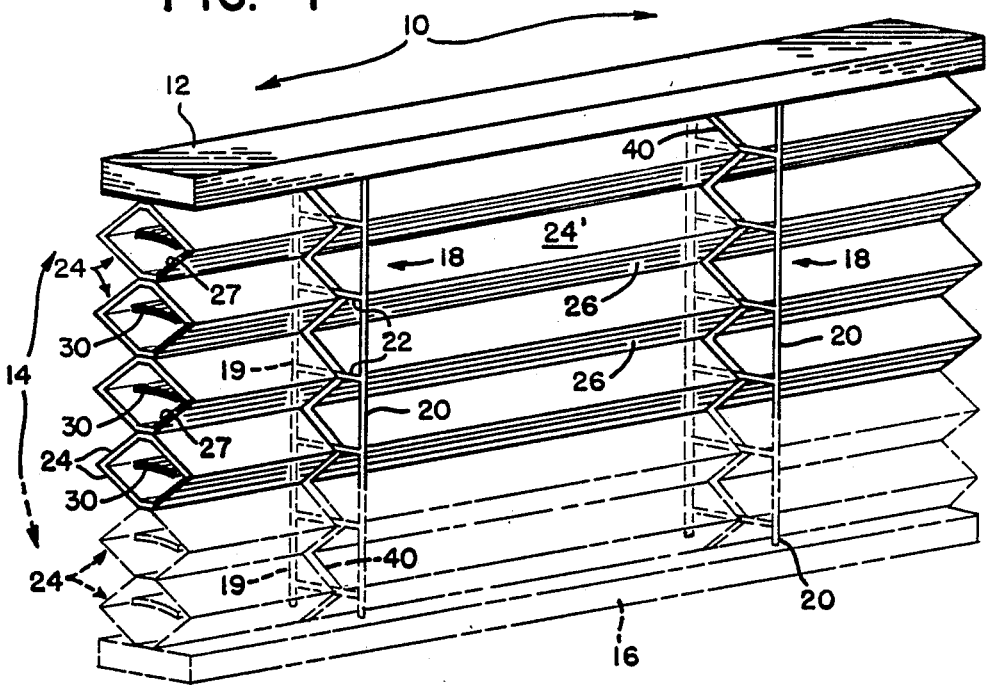
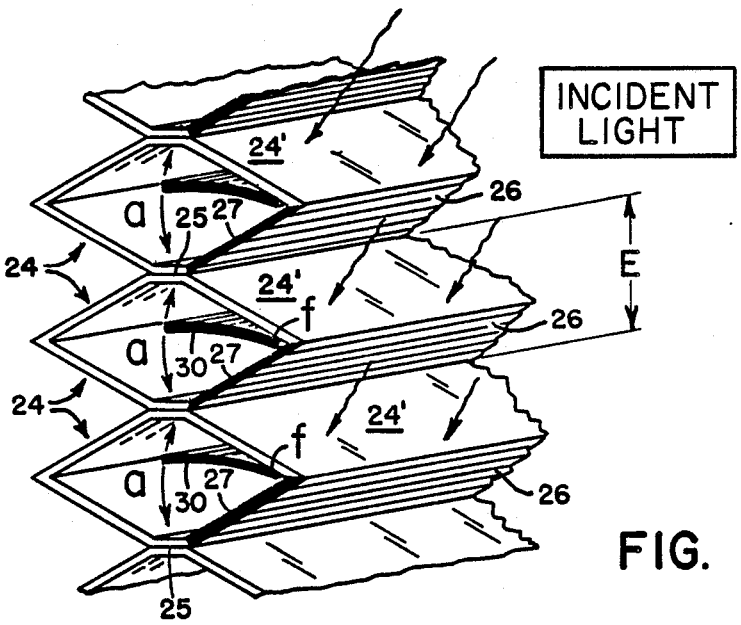
FIG. 2

ENVELOPED BLIND ASSEMBLY USING INDEPENDENTLY ACTUATED SLATS WITHIN A CELLULAR STRUCTURE

BACKGROUND OF THE INVENTION

1. Field of the Invention

This invention relates, in general, to multicellular curtains and Venetian blind assemblies, and more particularly to pleat-faced multicellular curtains which have Venetian blind components assembled intercellularly therewithin.

2. Discussion of the Prior Art

Many curtain designs have been proposed in order to realize shade apparatus that would provide functionally suitable and aesthetic window treatments. The two predominant designs that have received a great deal of inventor attention in the past five decades are the multi-slatted Venetian blind and the more current multicellular (pleated or flat faced) curtain. In the former, there has been suggested the use of interconnected slats, vertical (as well as horizontal) slats, independently operated slats, slats motivated to acquire a zig-zag configuration, and instantly, directionally arrayed slats connected by slat ligature having different opacity. Also within this genre, slats of differing reflective character have also been suggested by the instant inventor. Proposals in the multicellular curtain have included, as previously mentioned, flat-faced obverse-reverse curtain designs as well as pleated obverse-reverse (or mixed) designs such as one flat-faced curtain panel combined with a pleated panel. Between the panels of the cellular structure, the partitions are either orthogonal (to the flat-faced panels) or oblique (to, generally, the relief or pleat-faced panels). As with the Venetian blind, the unicellular or multicellular curtain structures have also incorporated areas or portions of varying opaqueness (or opacity) or reflectivity. All of these inventions have a common view toward the production of a highly functional, yet aesthetic window covering. In some instances, they are incorporated with glazing apparatus and are thus used to promote their purely utilitarian function, that of providing light controlling barriers in order to acquire more efficient thermal insulative properties. Thus, the main inventive thrust of this invention is to provide (but not disjunctively like its predecessors) controllable light transmission through a light-diffusing curtain by means generally described as fixed and movable reflective and/or opaque panels. The instant invention utilizes pleated (i.e., multipaneled), multicellular curtains, the obverse and reverse (or front and back) panels which are vertically displaced from each other, have between them a web ligature, the individual ligaments of which (the ligature) each connect the inside pleat ridge of one curtain panel with the inside pleat ridge of the other curtain panel that is adjacent to it but displaced vertically therefrom. In cross section, such a ligature appears as a zig-zag strip that connects one interior pleat ridge with an adjacent interior pleat ridge, thus forming in the multicellular curtain an alternating array of asymmetrically shaped, diamond-like cells. The one early disadvantage of the unicellular or multicellular curtain, relative to its suitability in meeting the instant inventor's aforementioned purposes, is that heretofore the flat-faced/pleated curtain could only effect totality (either light transmissivity through varying opacities of shade panels or non transmissivity) by raising or lowering the curtain. All the while, however, the Venetian blind, with its variable slat architecture, could be readily employed to vary the light transmissivity of a shade. It seemed reasonable that if the Venetian blind were incorporated with cellular curtains of the type herein mentioned, a highly utilitarian apparatus would result. If they were arrayed one behind the other, most of the desired characteristics sought by the instant inventor would be acquired, but at a tragic loss of space efficiency with no concomitant appreciation in the aesthetics. Some inventors did, indeed, work arduously to meld such concepts; and a discussion of their art now follows.

The 1976 patent for a SLATTED CURTAIN, issued to Ronkholz-Toelle, U.S. Pat. No. 3,946,789, discloses a curtain comprising vertical slats interconnected by transparent slats and so arranged that, when the curtain is open, each two adjacent covering (connected) slats form two sides of an H, while the transparent slat which connects them forms the crossbar of the H. This was an excellent application of the use of multiple planar slats, the array of which formed a light and thermal barrier, and which could, by varying the side slats (of the H) increase or diminish the light passing through the slat-formed curtain. Although not providing a great deal of insulative character, the Ronkholz-Toelle apparatus was quite functional and mildly aesthetically pleasing. The curtain was further foldable in that it could be gathered from a side (when hung in the vertical configuration) or drawn up from the bottom in conventional Venetian blind fashion. In 1985, Brockhaus obtained U.S. Pat. No. 4,535,828 for a WINDOW INSULATOR, a thermally efficient window shade comprising honeycomb slats (multicellular structure), pivotally and transverse hinged to a front panel, that were movable by a rear-(to the panel) mounted manifolding strap. The strap was used to raise and lower the pivotally hinged slats that were arrayed behind the flat-faced, room-facing panel. Because the array was set adjacent the window glazing, the multitude of slats stratified the air formed in the plenum between the glazing and the room-facing panel. Thus, a measure of insulative quality was achieved by the combination of the window glazing, the pseudo-glazing (front panel) and the slat array. No teaching was made by Brockhaus to sheath the slats with the panel structure and thus, he effected a Venetian blind apparatus with individual slats conterminous to the single-paneled curtain along the arrayed transverse slat edges. Again, as in Ronkholz-Toelle, an insulative thermal barrier having tasteful decor was acquired, but lacking true light control.

One of the most current, state-of-the-art entries in the multi-structure curtain assembly is provided in Anderson's 1987 patent, U.S. Pat. No. 4,677,012, for a HONEYCOMB STRUCTURE WITH BAND JOINED FOLDED MATERIAL AND METHOD OF MAKING SAME. In this disclosure of a cellular structure only, Anderson teaches various construction methods for acquiring the pleated (reverse and obverse) curtain comprised of a unicellular array of hexagonally shaped tubes. Also, disclosed by Anderson is a multicellular curtain comprised of transversely concatenated, pentagonally shaped unicells. Notable in this disclosure is the resulting curtain which displays a pleated obverse and a flat-faced reverse. Later in 1987, Bytheway, Jr., U.S. Pat. No. 4,708,188, taught a CABLE LADDER SYSTEM AND IMPROVED V-CLOSURE BLINDS. The use of a ladder, a cord actuating mechanism having the general shape of a ladder comprised of flexible rungs, was certainly not new in the field of Venetian blind actuation mechanisms. Nonetheless, Bytheway Jr. paired the ladder actuators on each side of his transverse slat array, and moreover, in his di-ladder paired array alternately spaced the rungs of the ladders so that when the two side rails of the pair were actuated individually and in opposite translational directions, the blind slats which were resting on the alternating individual rung pairs were rotated contrariwise. The contrarotation of adjacent slats thus effected, in the side rail translational limit, a zig-zag slat array which effected a closing of the Venetian blind giving an overall appearance to the observer of a pleated facia. After an exhaustive study of the literature and patents available, the instant inventor was able to find only this solitary Venetian Blind-pleat combination.

Final to this inspection of the prior art, and one of the most current available, is the disclosure of a VENETIAN BLIND which issued to Spangenberg as U.S. Pat. No. 4,723,586, in February 1988. Spangenberg disclosed a Venetian blind constructed and actuated so as to be suitable for mounting in the plenum that is realized between two panes of a multiply glazed window assembly. With the exception of the novel suspension and actuation means required for this unique combination of planar obverse and reverse panels, the Venetian blind apparatus is otherwise unremarkable. Clearly unsuitable for the purposes of the instant inventor is the use of a rigid, flat-faced curtain, whether spaced on either side of the Venetian blind or completely enveloping it. The flat faced glazing precludes any use of variable opaqueness (opacity) or reflectivity in the curtain and, by its rigidity clearly obviates the compressability or collapsibility inherent to either the uni/multicellular curtain or traditional Venetian blind arrays.

One final piece of prior art remains, salient in that without it the instant inventor could have not realized the useful and aesthetic embodiment of the instant invention. In a patent application, Ser. No. 287,740, filed on Dec. 22, 1988 and entitled MULTI-CELLULAR COLLAPSIBLE SHADE, Schnebly et al. disclose a multicellular shade consisting in obverse and reverse pleated curtains in which the pleat crests of the reverse were offset (vertically) one-half period from the pleat crests of the obverse and, more importantly, the internally facing pleat troughs which are in opposition, but also offset one-half period, are connected by a web ligature that forms, in cross section, a zig-zag array of ligaments. In viewing the aforementioned cross section of this multicellular shade (specifically a dual cell structure), an observer would note that, in deployment, the invention comprises a stacked array of alternating, asymmetric diamond cells of which the shallow vertices thereof form the obverse and reverse face pleats. It is this dual cell array (or any multicellular array) that is used to acquire the preferred embodiment of the instant invention.

It may now be readily surmised that the instant invention, in order for the inventor to teach the concept of a controllable light transmission technique through use of a light-diffusing shade that contains means therein comprising fixed and movable opaque/reflective panels, it would be necessary to somehow meld the two forms of window treatment (coverings) that have been heretofore discussed.

SUMMARY OF THE INVENTION

It has been established that there is a need for a combination window shade that is both light-diffusing and light-controlling. To fulfill this need, the present invention has been devised to incorporate different and functionally distinct prior inventions in a manner heretofore not contemplated nor physically realized. The main thrust of the instant invention is to provide controllable light transmission through a light-diffusing shade by use of an array of fixed and movable opaque or reflective panels that comprise a cellular type shade. More specifically, the instant invention comprises, in part, pleated, multicellular curtains which have between the front and rear panels (obverse and reverse, respectively) a zig-zag, continuous array of ligaments. The ligature of the preferred embodiment comprises a full web, having an origin and terminus at the top and bottom portions (or the ends) of the front and rear panels, which are pleated. Further, and characteristic of the preferred embodiment, the width of the zig-zag ligature spans the width of the pleated curtain, that is, from lateral edge to lateral edge. More definitively, the zig-zag web appears hingedly fixed along the transverse length of the pleat troughs that inwardly oppose each other (in the shade interior) but are stacked in a staggered, half-period offset, relationship. Hereinafter, reference to the figures of this disclosure, particularly FIG. 1*b*, will make this relationship clearly evident to the reader. It is this relationship that makes the multicellular (including the dual cell) curtain so adaptive in the instant invention. In the preferred embodiment, the ligature (the zig-zag ligament structure, either discrete straps or a continuous web) bears no unusual attributes, save that in-line apertures are provided through the length of the curtain, the apertures being inward of the lateral curtain edges and of sufficient length and width to accommodate therethrough flexible ladder elements such as are currently used to actuate Venetian blinds. Again, the multicellular shade better lends itself than the unicellular to the hereinafter disclosed adaptation by allowing such an aperture arrangement to pass through the (ligament) web without any exposure outward of the faces of the pleated curtain. It is virtually impossible to acquire this feature, with its absolute "invisible ladder" aesthetic feature, in anything less than a multicellular shade. Thus, the unicellular shade, like (use of) the discrete or separate-strap ligature, is an alternate embodiment only. Final to the pleated shade, comprised of a flexible, light-diffusing material, are a series of fixed opaque or reflective panels. Hereinafter, these panels shall be referred to as (lower) fixed slats because functionally they comprise one side (bottom) of a pleat. For example, if the pleated curtain were hung in a fashion so that the pleat crests and troughs were arrayed parallel and horizontal to the ground surface, the fixed slats would be the lower pleat halves; and, if the pleated curtain were hung or suspended by its lateral edge, the pleat crests and troughs being essentially parallel but vertical to the ground, the fixed slats would form a uniform slatted array of either the left or the right halves (panels) of the pleat array. Hereinafter, the reader will be presented the remainder of this disclosure with consistent reference to the invention as displayed in the former mode, i.e., the crest and trough planes parallel to the ground surface. Thus, the lower fixed slats differ from the upper only to the extent that they are specially fabricated of, coated, or infused with opacifying substances or, if desired by the producer, reflectively or otherwise coated on the inside facing of the shade panel.

To complete the aforementioned combination, a conventional Venetian blind network is intercellularly inserted into the shade. In the construction phase, at least one pair of ladders are employed, with one passing through each in-line aperture system that is inward of the curtain lateral edge. The ladder system is arranged so that only one side rail (or cord) need be translated, while the other remains essentially fixed. The translation of a ladder side will cause the rungs attached to that side to move uniformly through a certain distance. In a first position (the null), the rung-rail intersection is contiguous to a ligament. Thus, when a Venetian blind slat is passed through the cell, it lies disposed on the innermost rung-rail intersections; and one full transverse edge lies conterminous to an inside (the) curtain trough. Thereafter, translation of the translatable ladder rail moves the slat array uniformly in an arcuate path so as to, in the extreme, place the slats in complete planar registry with the ligament immediately displaced from the rest ligament, called the contact ligament. It may be readily seen, therefore, that when (optionally) the blind slat is of a reflective/opaque material, the transitional activity within the multicellular structure grants the overall apparatus a truly light-diffusing and light-controlling utility. Further to the invention, when the pleated panels are untreated (optionally) and the opacification or reflection process is performed only on portions of the ligature (here, the transversely continuous web or in the square, cell-upon-cell, unicellular array, the separate cell partitions), the objectives of the invention are fully realized and the resulting product retains all of the aesthetics of a pleated, light-diffusing curtain of the light controllable type. All actuating cordage and light-controlling apparatus is secluded from view in the multicellular or the horizontal square unicellular structures.

BRIEF DESCRIPTION OF THE DRAWINGS

Of the Drawings:

FIG. 1 is a partial isometric illustration of the invention;

FIG. 2 is an isometric section of a lateral edge of the FIG. 1 invention, an alternate embodiment;

DETAILED DESCRIPTION OF THE PREFERRED EMBODIMENT

Figure 3:
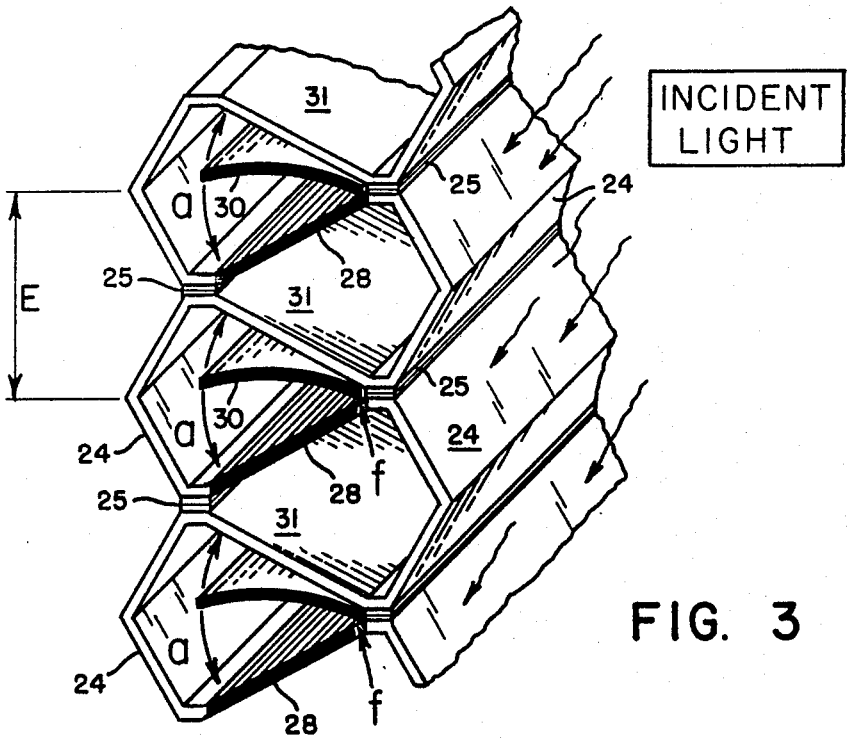
FIG. 3 is an isometric section of a lateral edge of the preferred embodiment of the invention.

Throughout the following exposition, the reader should remain aware of certain factors governing the use of the instant invention, as well as the ancillary benefits derived therefrom. A major factor concerns the selection of the pleated curtain structure best suited to carry out the invention. The instant inventor feels that he has adequately pointed out that any cellular structure, whether unicellular or multicellular, is suitable for effecting a working embodiment. However, another underlying factor in the development of the present invention is the need to acquire a tasteful aesthetic character in the finished product. This obtains from the knowledge that, in the making of modern window treatments, achievement of high utility is simply not enough. In order for the consuming public to accept and utilize a new concept, proffering the article with advertisement of environmental benefit and useful application often fails to sell it if that article does not satisfy minimum aesthetic needs. Although the predominant type of unicellular, pleated curtain embodiment, the FIG. 1 item, shall be hereinafter discussed, the instant inventor strongly urges the use of the multicellular, particularly dual cell, structure in order to fully acquire the utilitarian (both apparent and latent) and aesthetic characteristics. Relative to the latent benefits, the reader will notice throughout the following disclosure that the use of the Venetian blind ladder and slat structure compels a uniform distribution of the cellular curtain weight. This is extremely important when the user opts to use a multicellular structure. Moreover, the blinds compel a proper actuation of the cellular array by mandating a complete expansion (note E in FIGS. 2 and 3) of each deployed (expanded) cell.

Referring more particularly to FIG. 1, the invention 10, disclosed isometrically and in partial detail, comprises a fixed sill or header 12 from which is suspended a unicellular pleated curtain 14 comprised of square cells concatenated vertex to vertex. The bottom sill 16 is shown in phantom and may be realized with a mechanism similar to the fixed sill 12 or any other suitable apparatus. Those of ordinary skill will recognize that this apparatus, utilizing an expansible and collapsible/-contractable shade 14, may be generally collapsed by drawing the movable sill 16 upwards. Therefore, draw cordage is not illustrated in any of the drawings hereinafter presented. Continuing in the FIG. 1 illustration, the observer immediately notes the presence of ladder halves 18 comprised of rail cord 20 and rung cord 22. Hidden from view, and interior to the cellular complex, is the remaining half 19 of the ladder structure 18. The enveloped ladder mechanism 19 is displayed in phantom only at the left lateral portion of the illustration. The remaining details of FIG. 1 are the front or obverse pleats 24 and the rear or reverse pleat structure, essentially the same as the obverse save for the lower slats 26 thereof, alternately termed lower fixed slats. The "slat" nomenclature is reserved in this instance because, relative to the hereinafter disclosed and discussed blind assembly, the pleat facia (expanded) can be considered an array of fixed slats arranged in a zig-zag or pleated format. The lower fixed slat 26 is highlighted in this discussion because, as mentioned earlier in the dicussion of the unicellular curtain, it is used to acquire one portion of the light-controlling character of the invention, in that the internal surfaces 27 of the lower fixed slat 26 are intentionally opacified or made reflective through the use of special manufacturing techniques or coatings as disclosed in (previously mentioned) U.S. patent application Ser. No. 287,740 filed on Dec. 22, 1988. Final to the FIG. 1 illustration, but more clearly defined in FIG. 2, are the intracellular slats 30 Which, With the ladder 18 elements and the two sills 12, 16, form a Venetian blind ensemble. FIG. 2 clearly shows the cell slat detail of the embodiment which, in gross, comprises obverse pleats 24, reverse pleats consisting in upper slats 24' with specially treated lower slats 26. A light-altering coating 27 is clearly seen on the shade-interior portions of lower slats 26. The intracellular slats 30, having been treated for opacity or reflectivity in the same fashion as lower slats 26 are seen disposed with one transverse edge practically resting in, and functionally conterminous to, the vertex of a reverse facing panel pleat. The slat 30 may be actuated so as to move through arcuate distance a. Final to this illustration are the glue lines 25 which join the individual cells of this unicellular array. The ladder sides 19 shall later be seen to pass through these glue line junctures and it will be readily seen that the actuation of slats 30 through distance a will clearly enhance operation of this cellular embodiment by compelling expansion E to the fullest when slats 30 are rotated into registry with upper slats 24'. Rotation of slats 30 to effect maximum expansion E will have the concomitant benefit of uniformly distributing the cell array weight, a functional enhancement which has already been accomplished in part by the pleat vertices' distribution over the slats 30 fixed transverse edges f. The reader may now see how the invention works with this cellular arrangement. Incident light, represented by the barbed wavy lines, falls on the reverse pleated face of the suspended and expanded curtain 14. If the slats 30 of the Venetian blind array are in registry with the lower slats 26, called the "rest" position, the incident light will pass completely through upper slats 24' (which are, to varying degree, light transmitting) and, reflecting off slats 30, will be diffused through obverse panel pleats 24. Actuation of the blind mechanism will move slats 30 through all or part of arcuate distance a toward the "contact" position (of) complete registry with upper slats 24' of the upper/-lower slat combination 24', 26 to form, in effect, a continuous reverse panel of (treated) upper and lower slats and effect the maximum (exclusion) light control of the invention.

It may be seen that, although the major objectives of the inventor are realized with a FIG. 1 embodiment, the lack of aesthetics conditioned upon the use of externally visible ladder cordage is troublesome. Thus, use of a cellular embodiment that will completely seclude or hide all of the Venetian blind assembly is mandated and the preferred embodiment comprises the use of a dual cell structure from the multicellular class. It should be noted that the instant inventor has clearly contemplated an unicellular structure using the square cell of FIG. 1, but in an array of simply stacked horizontally disposed cells (not shown). Such an arrangement requires a form of pleating in order that the curtain (cellular array) may be drawn or collapsed. The main distinction between such an arrangement of square cells concatenated side to side (conterminous placement) and that of concatenated vertices (FIG. 1) is that the side contiguity allows disposition of the ladder network 18, 19,22 invisibly between curtain obverse and reverse panels. It follows then, that the (conterminous side) partitions are treatable as the web ligature of the multicelled curtains.

Figure 4:
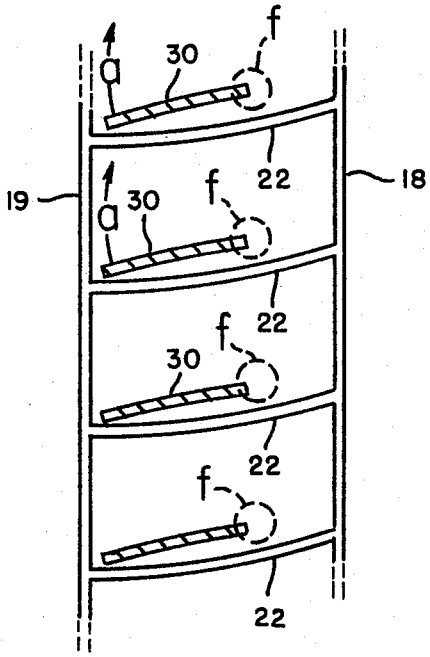
FIG. 4 is a schematic side elevation of the Venetian blind array.
Figure 5A:
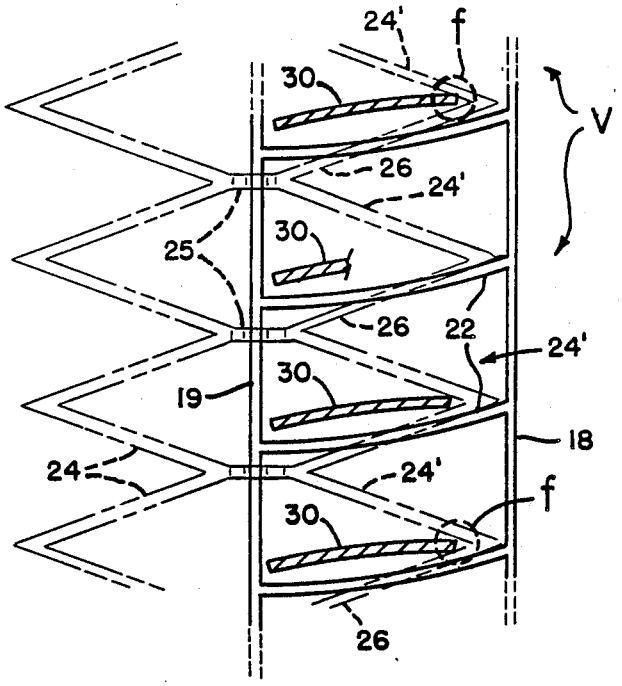
FIG. 5A is a side elevational schematic of the Venetian blind of an alternate embodiment.
Figure 5B:
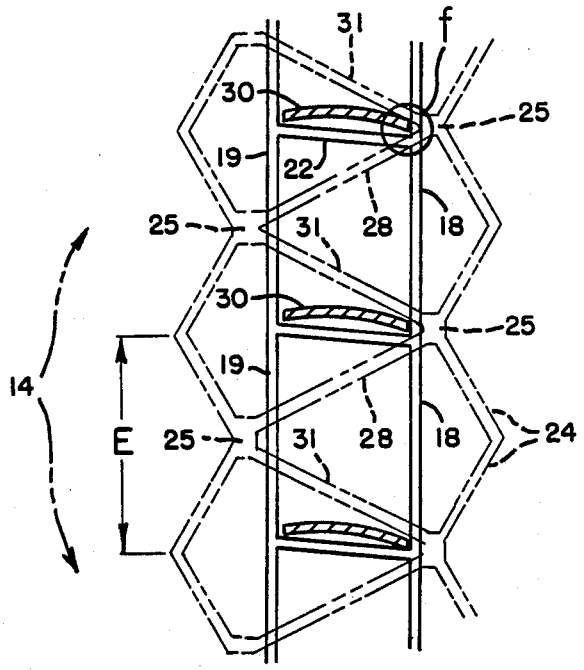
FIG. 5B is a side elevational schematic of the preferred embodiment.

FIG. 3 is the dual cell analogue of the FIG. 2 apparatus. The reader should note what the inventor means by "dual cell"; which is now defined: A multicellular (including dual cell) structure is one in which there exists an intercellular partitioning that effects a ligature of the continuous or discontinuous, parallel type. This is, in fact, a characteristic of all multicellular structures available today, some of which are termed honeycombed. In FIG. 3, the most distinctive feature that one viewing the shade would observe is that no slat cordage protrudes through either the obverse or reverse panels of the shade. In all obverse externalities, the FIG. 1 and the FIG. 3 embodiments would appear identical. Internally and on the reverse panel, however, the structures are quite different. First, there is observed the ligature 28, 31 which zig-zags through the interior of the structure running first to one glue juncture 25 (or, if an adhesive is not used, a pleating margin or seam) to another that is in the next seam plane adjacent, but displaced a partial pleat period from it. Also in this embodiment, if the reader will but trace the zig-zag ligature, the alternating placement of the cell partitioning ligature should be noted, 31-28-31-28-etc. In the herein shown dual cell arrangement, only one set of zig-zag ligature is seen; whereas, in more than dual multicellular structures, zig-zag ligature would exist in a first direction, then in a number of planes, variably from oblique to orthogonal(-to)the first direction. However, all further reference to a multicellular structure, save in the claims, is confined to the dual cell structure because it is relatively easy to construct, is lightweight and lends itself comfortably to the incorporation of the Venetian blind assembly with but a single zig-zag ligature therethrough. Returning the FIG. 3 reference, the reader, having acquired a notion of the invention's operation from the FIGS. 1 and 2 discussion, may readily ascertain how the invention works vis-a-vis the FIG. 3 embodiment. During the manufacturing process, discrete transverse panels, slats or portions are created (or a continuous web is so treated) so that the ligature is formed in the aforesaid alternating (31-28-31) pattern. Note that the preponderence of incident light falling on the reverse portion of the shade (there still exists a true obverse and reverse because of the orientation of the internal slat structure), is diffused inward of the shade, entering through the pleated face 24 (not 24', which is the upper "fixed" slat of FIGS. 1 and 2). If the slats 30 are in the rest configuration, they are properly in registry with the whole of bottom sections 28 of the ligature. The incident light will defuse through the cell striking the surface of at-rest slats 30 and thereafter reflect off the slats and diffuse through the obverse faces 24 in the same fashion that it entered. The blind slats are arcuately actuated to pass through distance a until contacting the upper slats 31 of the ligature, thus controlling the reflection and subsequent diffusion of the incident light which has passed into the cells. As in the unicellular embodiment, the transverse edges of the slats 30 closer to the cell vertices f continue to provide substantial support for the deployed shade. This support relieves considerable shade weight stress from the glue lines 25. Also, by movement towards and into the contact position, slats 30 serve to compell full expansion E of the cellular structure. The side elevational schematic of FIG. 4 shows how a ladder and slat array is established for use with the FIG. 3 embodiment. Again, rails 18 are essentially fixed which, of course, lends the fixed character f to the transverse edges of slats 30. It is such an edge that is confined essentially within a cell acute vertex or, if viewed from the outside, nested conterminous to a pleat trough. The movement of translating legs 19 would cause the slats 30 to effect the arcuate path a. This follows because slats 30 effectively Pivot on points of juncture in cell vertices f. References to FIGS. 5A and 5B establish more comprehensively the relationship of the ladder and blind slat apparatus in relationship to the unicellular array (FIG. 5A) and the multicellular array (FIG. 5B). In the first, FIG. 5A, the right hand side of the ladder element 18, 22 is seen extending beyond the pleat face 24', 26, herein depicted in phantom. It may be seen that the ladder rungs 22 do not lend any support to the shade structure, but rather, it is the transverse edges of slats 30, nested in the cell vertices at points f that provide the actual cellular support. Then, as translating ladder rail 19 is moved upwardly, the rails 18 motivate the internal transverse edges of slats 30 upward, effecting an arcuate path. In this particular embodiment, the translating side rail 19 is passed through the cell glue strip (junctures) lines 25. Unlike the ladder installation in a multicellular curtain, the FIG. 5A usage tends to weaken the juncture 25 and the unique strengthening character along the transverse fulcrums f serve only to ameliorate the harsh effect of piercing the glue juncture 25 network. For this reason, because a good portion of the ladder network is visible V, the instant inventor strongly recommends the embodiment depicted in FIGS. 3, 5B and 6B. In FIG. 5B, the multicellular analogue of the FIG. 5A apparatus, the reader will note that the entire Venetian blind apparatus is contained between the cell glue lines-pleat troughs 25, thus preserving to the invention a wholesome aesthetic character. Also, as depicted in the upper right hand quadrant of FIG. 5B (the encircled area f), the transverse slat edge is nested in the fixed cord 18 rung 22 juncture adjacent all the glue-reinforced trough glue lines 25 of the obverse face. Thus, with the multicellular curtain, the Venetian blind ladder structure more effectively supports the cellular curtain irrespective of the slats' 30 positioning or the degree of expansion E of the shade. Those of ordinary skill will recognize that the Venetian blind-enveloped structure of the instant invention need not carry with it all of the incidents herein mentioned. For example, it is possible to dispense with the pleated shade by simply altering the length of ligaments 28, 31 and avoiding the crests of the pleated obverse and reverse faces. Were this to be carried out, FIG. 5B would appear similar as herein depicted, with the exception that the obverse and reverse faces of the cellular shade would be coplanar and have therein no pleated relief. We would have realized, but for the details of the structure, the window-enclosed Venetian blind assembly which is so popular in modern commercial buildings. The salient difference between the latter commercial embodiment and the instant invention would be the instant's flexibility and collapsability.

Figure 6A:
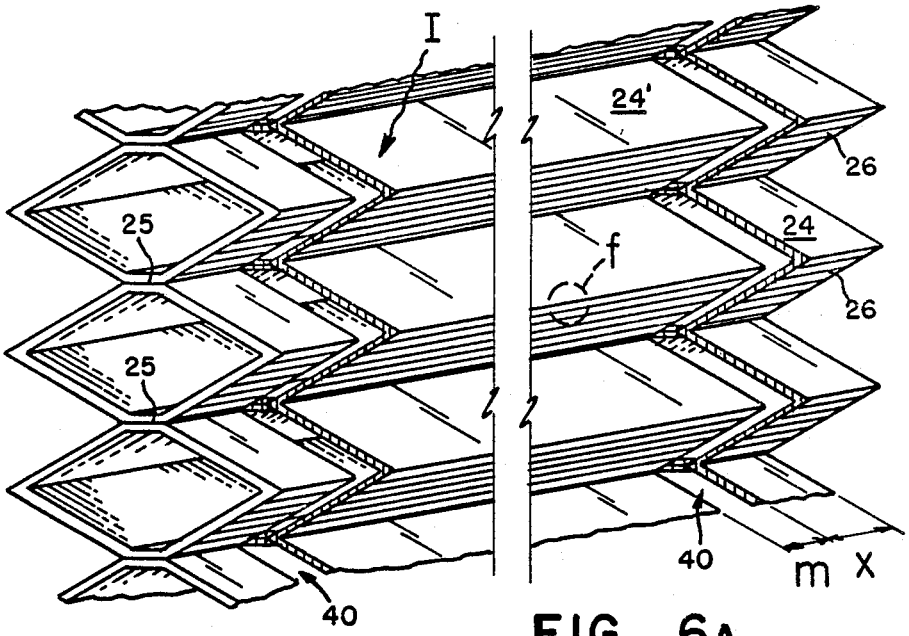
FIG. 6A is an isometric illustration of the alternate embodiment curtain with apertures; and, FIG. 6B is an isometric illustration of the preferred multicellular pleated curtain with apertures hidden by pleated curtain faces.
Figure 6B:
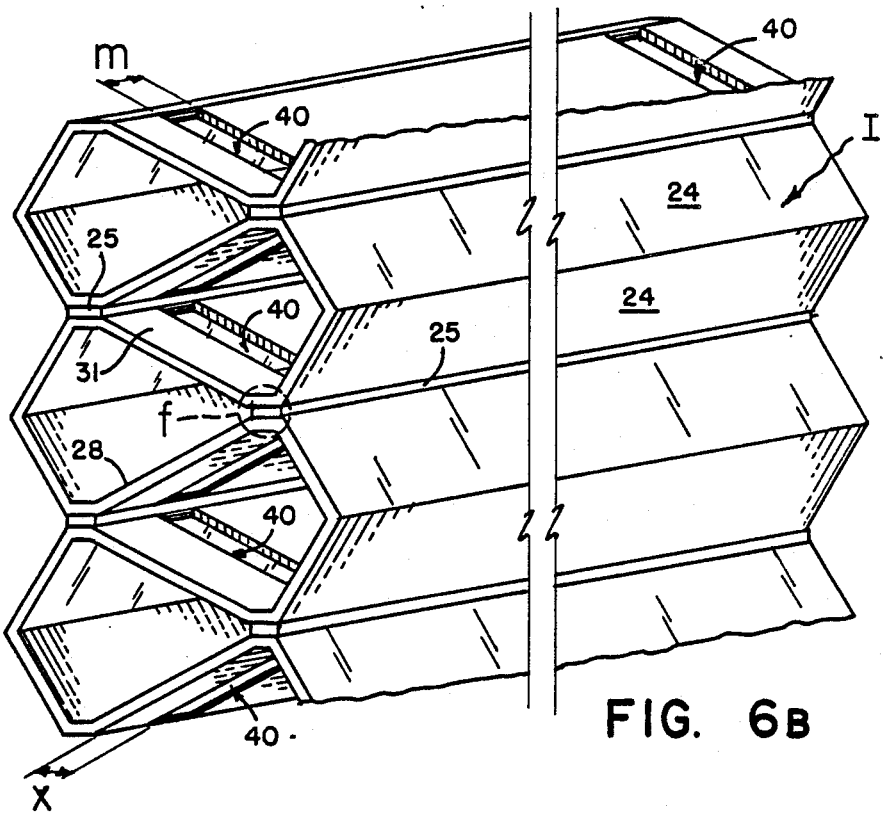

The final incidents of the present invention are those necessary to physically incorporate the ladder cord network 18, 19 and 22 into the cellular structure. FIGS. 6A and 6B depict the aperture geometry 40 which is used to effect ladder passage in the unicellular and multicellular structures, respectively. Referring first to FIG. 6A, the reader should note that the aperture protocol comprises removal of a continuous segment from the reverse side of the unicellular curtain, beginning at the locus of pleat verticies, at a point proximate the lateral edge, and moving parallel to it and transverse to the crest-trough geometry, through to the intercellular glue structure 25. It can be readily observed that the fulcrum edge f of the blind slat 30 shade contact is clearly a segmented structure by virtue of the fact that the entire face of the shade is so segmented. Here, an aperture width of m is depicted at some distance x from the lateral edge of the shade. If desired and necessary, a third ladder may be added at some point presumably equidistant the lateral edge placements 40. By way of contrast, the multicellular embodiment depicted in FIG. 6B clearly lends itself to the aperture networks 40 that pass through the zig-zag ligature 28, 31, completely avoiding the cell junctures 25. As in the FIG. 6A embodiment, apertures 40 are made (but only) to the internal ligaments, at a preselected distance x from the lateral edges of the curtain. It is readily apparent that this ladder structure should be, and is, the preferred embodiment of the invention.

By way of synopsis, the instant inventor presents the most notable advantages in the use of the herein disclosed apparatus. First and foremost, the invention provides diffusion and variable light control in a singular shade product. The use of the ladder cord imposes a uniform cell spacing on the cellular curtain, thus eliminating over-stretching of cells in shades or curtains where the web tension alone suspends the lower cells. The light control system imposes no bending load on the curtain material, allowing low forces and uniform actuation, even on large-area shades. Productionwise, the preferred embodiment can be automatically assembled using current technolgies and modified Venetian blind equipment. Although not expounded upon in this disclosure, but apparent to those of ordinary skill, is the fact that the instant invention, in either embodiment, may be raised and lowered (collapsed and expanded) independant of blind slat rotation, yet by using the same draw (pull) cord systems as are used in conventional Venetian blinds.

Through practice with the herein disclosed apparatus, the user may be stimulated to make several different variations of the inventor's basic concept. Such activity will lead, undoubtedly, to a broad spectrum of applications having enhanced aesthetic characteristics. Such is commend to the public in keeping with the patent philosophy and restricted only by the hereinafter appended claims.

What is claimed is:

1. A flexible and collapsible-expansible, pleated multicellular shade array having spaced-apart, pleated obverse and reverse faces and pleat trough joining means to connect opposing troughs of said faces to form individual sleeve-like cells in said shade and further, including within individual cells that lie in a singular plane within said shade, a pivotally movable Venetian blind slat.

2. A pleated multicellular shade with internal means for controlling light transmission therethrough comprising:

an expansible and collapsible multicellular curtain comprising transversely arrayed fabric tubes joined to each other longitudinally along their surfaces to form a stacked cellular array of such tubes, said array having distinct pleated obverse and reverse faces and defining a cell-like structure therebetween;

a conventional Venetian blind system, including actuation means, installed within said cellular array so that each blind slat is disposed singularly and wholly within each of said tubes that lie within a discrete blind plane, said Venetian blind system distinct from said celluar array; and means for moving in an arcuate path and independent of said cellular array all transverse edges of slate disposed within said tube and which are adjacent one face of said curtain.

3. A method for making a pleated multicellular shade, said shade having internal means for controlling and diffusing light, comprising the steps of:

obtaining a multicellular double paneled shade having pleats on at least one panel thereof;

creating a series of in-line apertures in interior cell partitions of said multicellular double paneled pleated shade in which pleat troughs of a pleated panel are joined to a second panel by means which form and thereby define multiple cells within said shade; and disposing in each cell that lies in a common plane passing coplanar and lengthwise through said pleated shade between said panels a singular blind slat, said disposing further comprising lengthwise enveloping each slat by a cell and further, providing separate actuating means for both slats and cells.

4. In a combination of a multicellular, pleated shade and a Venetian blind slat array, said blind slat array disposed in said shade, one slat to a cell along at least one coplanar cellular plane of said shade, and each slat having a rotatable transverse edge and an essentially stationary nonrotatable transverse edge, cord means for rotation of said rotatable blind transverse slat edges along said plane so that actuating said cord means arcuately moves each said slat about a pivotation means of a pleated cell and compels full expansion of said shade cells while said nonrotatable transverse slat edges essentially bear all weight of said shade along said pivotation means of each said cell.

5. A flexible, collapsible-expansible, multicellular shade-blind combination comprising:

a multicellular, pleated shade including a pleated obverse face curtain in spaced-apart registry with a reverse face curtain, pleats of said obverse curtain defining crests and troughs, said troughs each joined through connection means to opposing points on said reverse curtain so that adjacent troughs of an obverse curtain pleat and an opposing surface in said reverse curtain are joined through said connection means to cooperatively form a least one elongate cell joined longitudinally adjacent to another cell to comprise a plurality of said cells arrayed to form said shade;

a multi-slated Venetian blind array disposed within said shade so that each slat of said blind resides intracellularly, that is, within a discrete cell of said shade to form said shade-blind combination;

means for collapsibly and expansibly actuating said shade to cause its deployment and retractions; and means for arcuately moving an aligned set of transverse edges of said slats of said blind, whereby expanding said shade and moving said edges of slats that are disposed intracellularly therein regulates the amount of shade-incident light that passes through said shade.

6. The invention of claim 5 wherein said connection means, which related to said shade, is glue.

7. The invention of claim 6 wherein said connection means includes a ligature that joins said troughs to surfaces of said reverse face curtain.

8. The invention of claim 5 wherein said means for actuating said shade comprises conventional multicellular shade or Venetian blind deployment/retraction mechanisms.

9. The invention of claim 5 wherein means for arcuately moving said slats of said Venetian blind comprises at least a half portion of a conventional Venetian blind ladder actuation mechanism.

10. The invention of claim 7 wherein said ligature is zig-zag and contains multiple ligaments which form nominally diamond shaped multiple cell cross sections interstitial of said shade obverse and reverse face curtains.

11. The invention of claim 6 wherein said connection means contains therethrough a series of aligned apertures and further, there is disposed within said series at least a portion of a conventional Venetian blind ladder cord mechanism.

12. The invention of claim 7 wherein said connection means contains therethrough a series of aligned apertures and further, there is disposed within said series at least a portion of a conventional Venetian blind ladder cord mechanism.

* * * * *